US006564764B2

(12) United States Patent
Karbstein et al.

(10) Patent No.: US 6,564,764 B2
(45) Date of Patent: May 20, 2003

(54) SWITCHABLE TAPPET FOR DIRECTLY TRANSMITTING A CAM LIFT ONTO A TAPPET PUSH ROD

(75) Inventors: Henning Karbstein, Strullendorf (DE); Mario Kuhl, Herzogenaurach (DE); Alfred Borst, Erlangen (DE); Michael Haas, Weisendorf (DE)

(73) Assignee: Ina-Schaeffler KG, Herzogenaurach (DE)

( * ) Notice: Subject to any disclaimer, the term of this patent is extended or adjusted under 35 U.S.C. 154(b) by 0 days.

(21) Appl. No.: 10/150,768

(22) Filed: May 17, 2002

(65) Prior Publication Data

US 2002/0185095 A1 Dec. 12, 2002

(30) Foreign Application Priority Data

May 17, 2001 (DE) ..... 101 23 964

(51) Int. Cl.[7] ..... F01L 1/14

(52) U.S. Cl. ..... 123/90.48; 123/90.49; 123/90.52; 123/90.55; 123/90.65; 123/90.67; 123/90.16

(58) Field of Search ..... 123/90.48, 90.49, 123/90.52, 90.55, 90.65, 90.66, 90.67, 90.15, 90.16, 90.17, 90.61, 90.62, 90.63, 90.64

(56) References Cited

U.S. PATENT DOCUMENTS 5,361,733 A 11/1994 Spath et al. ..... 123/90.16
5,546,899 A * 8/1996 Sperling et al. ..... 123/90.5
5,662,075 A * 9/1997 Lyndhurst ..... 123/90.48
6,164,255 A * 12/2000 Maas et al. ..... 123/90.16

FOREIGN PATENT DOCUMENTS

| | | | | |
|---|---|---|---|---|
| DE | 552 696 C | | 6/1932 | |
| DE | 42 06 166 A1 | | 9/1992 | |
| DE | 42 10 567 A1 | | 10/1992 | |
| DE | 42 44 726 A1 | | 5/1994 | |
| DE | 43 35 431 A1 | | 4/1995 | |
| DE | 198 44 202 A1 | | 3/2000 | |
| DE | 19902445 A1 | * | 7/2000 | ..... F01L/1/25 |
| EP | 0 771 937 A1 | | 5/1997 | |

* cited by examiner

*Primary Examiner*—Thomas Denion
*Assistant Examiner*—Ching Chang
(74) *Attorney, Agent, or Firm*—Henry M. Feiereisen

(57) ABSTRACT

A switchable tappet for directly transmitting a cam lift onto a tappet push rod, includes a housing having a push rod distal end which is formed with a ramp surface for contact by a cam. An inner element is placed in a recess of the housing and has a push rod proximal end formed with an abutment for the push rod. Secured to the push rod proximal end of the inner element is an attachment to extend the inner element beyond the recess of the housing, wherein the attachment has a housing-distal end formed with a shoulder. A helical compression spring extends between the shoulder of the attachment and a rim of the housing for urging the inner element in a direction of the push rod, and conically expands, at least partly, in the direction of the push rod and is wrapped around the attachment of complementary conical configuration.

14 Claims, 1 Drawing Sheet

SWITCHABLE TAPPET FOR DIRECTLY TRANSMITTING A CAM LIFT ONTO A TAPPET PUSH ROD

CROSS-REFERENCES TO RELATED APPLICATIONS

This application claims the priority of German Patent Application Serial No. 101 23 964.5, filed May 17, 2001, pursuant to 35 U.S.C. 119(*a*)–(*d*), the subject matter of which is incorporated herein by reference.

BACKGROUND OF THE INVENTION

The present invention relates to a switchable tappet for directly transmitting a cam lift onto a tappet push rod, especially in a valve train of an internal combustion engine.

German Pat. No. 198 44 202 describes a tappet of a type involved here, including a housing formed with a recess for receiving an inner element for movement in longitudinal direction and abutment by a push rod. At a side distal to the push rod, the housing has a ramp surface for contact by a cam. The inner element is extended beyond the recess of the housing and is acted upon by a spring assembly comprised of two compression springs and received in the housing. The spring assembly rests on one end against a housing bottom and on the other end against an underside of the inner element. This conventional tappet suffers shortcomings because the arrangement of the spring assembly results in an unnecessarily long housing length, as a result of the required spring deflection plus the block size of the spring assembly. Thus, the tappet is overall of long dimension between its abutment against the inner element for the push rod and the cam ramp surface, so that the total mass is increased and the overall construction is complicated. Moreover, manufacturing costs are increased, as a number of outer surface areas are not smooth and of long size, and require cost-intensive fine machining operations, such as grinding.

It would therefore be desirable and advantageous to provide an improved switchable tappet to obviate prior art shortcomings.

SUMMARY OF THE INVENTION

According to one aspect of the present invention, a switchable tappet for directly transmitting a cam lift onto a tappet push rod, in particular in a valve train of an internal combustion engine, includes a housing formed with a recess and having a push rod distal end which is formed with a ramp surface for contact by a cam, an inner element disposed in the recess for movement into at least one position in which the inner element is coupled to the housing, wherein the inner element has a push rod proximal end formed with an abutment for the push rod, an attachment secured to the push rod proximal end of the inner element to extend the inner element beyond the recess of the housing, wherein the attachment has a housing-distal end formed with a shoulder, and a helical compression spring, extending between the shoulder of the attachment and a rim or rim-proximal region of the housing, for urging the inner element in a direction of the push rod, and conically expanding, at least partly, in the direction of the push rod and wrapped around the attachment of complementary conical configuration.

The present invention resolves prior art problems by shifting the arrangement of the compression spring to the outside so that the housing and thus the entire tappet can be constructed significantly more compact compared to conventional tappets. As a consequence, the overall mass of the tappet can easily be reduced. The conical configuration of the compression spring with its attachment contributes to a further shortening of the overall tappet length, when compared to conventional helical cylindrical compression springs. The conical configuration also ensures a sufficient mobility of the push rod upon the abutment during operation of the valve drive. Of course, the free mobility of the push rod may also be established by manufacturing only the inner surface area of the attachment in a conical way.

Despite the conical configuration of the attachment, it may also be possible to make the compression spring cylindrical or partly cylindrical for certain applications. It is also conceivable to provide a conical spring assembly with compressions springs nested within one another.

Measured between the abutment for the push rod and the ramp surface for the cam, the tappet should have a length which at a maximum is about ⅔ of a length of conventional tappets for valve drives in internal combustion engines of this type.

According to another feature of the present invention, the attachment may be a separate structural element and made of thinwalled lightweight material to keep the overall weight to a minimum. Examples of lightweight material for making the attachment include sheet metal or plastic. Suitably, the shoulder of the attachment is formed in one piece with the attachment and configured as ring collar extending from the attachment. Of course, the shoulder may also be a separate part that is connected to the attachment.

According to another feature of the present invention, the attachment may be connected to the outer or inner surface area of the inner element by a clip connection or snap connection. Such a connection is easy to realize. Other types of connection at the disposal of the skilled artisan may be suitable as well. Of course, it is also conceivable to provide the attachment in single piece configuration with the inner element.

A simple securement of the attachment can be realized by providing the inner element with a necking in an axial area of the rim of the housing. Suitably, the attachment is secured to the outer surface area of the inner element in the area of the necking. Of course, it is also conceivable to secure the attachment to the inner surface area of the inner element.

According to another feature of the present invention, the inner element has a ramp surface proximal side which is provided with a cylindrical impression whereby the ramp surface for the cam may be implemented as a rolling bearing mounted roller. In this way, the overall size of the tappet is further reduced, because part of the end face of the inner element moves over the roller as ramp surface in off-mode of the tappet.

According to another feature of the present invention, there is provided a hydraulic clearance compensation element, which is disposed in the inner element. As a consequence, additional adjustment measures for the valve clearance in the valve train, also of mechanical type, can be omitted. Supply of the hydraulic clearance compensation element may be implemented selectively via the push rod or a guide member enclosing the housing. The same is true for the coupling means, not described in more detail here.

According to another feature of the present invention, the housing may have a thinwalled structure and exhibit at least over a major part thereof a continuously open, tubular configuration.

BRIEF DESCRIPTION OF THE DRAWING

Other features and advantages of the present invention will be more readily apparent upon reading the following description of currently preferred exemplified embodiments of the invention with reference to the accompanying drawing, in which the sole

DETAILED DESCRIPTION OF PREFERRED EMBODIMENTS

Figure 1:
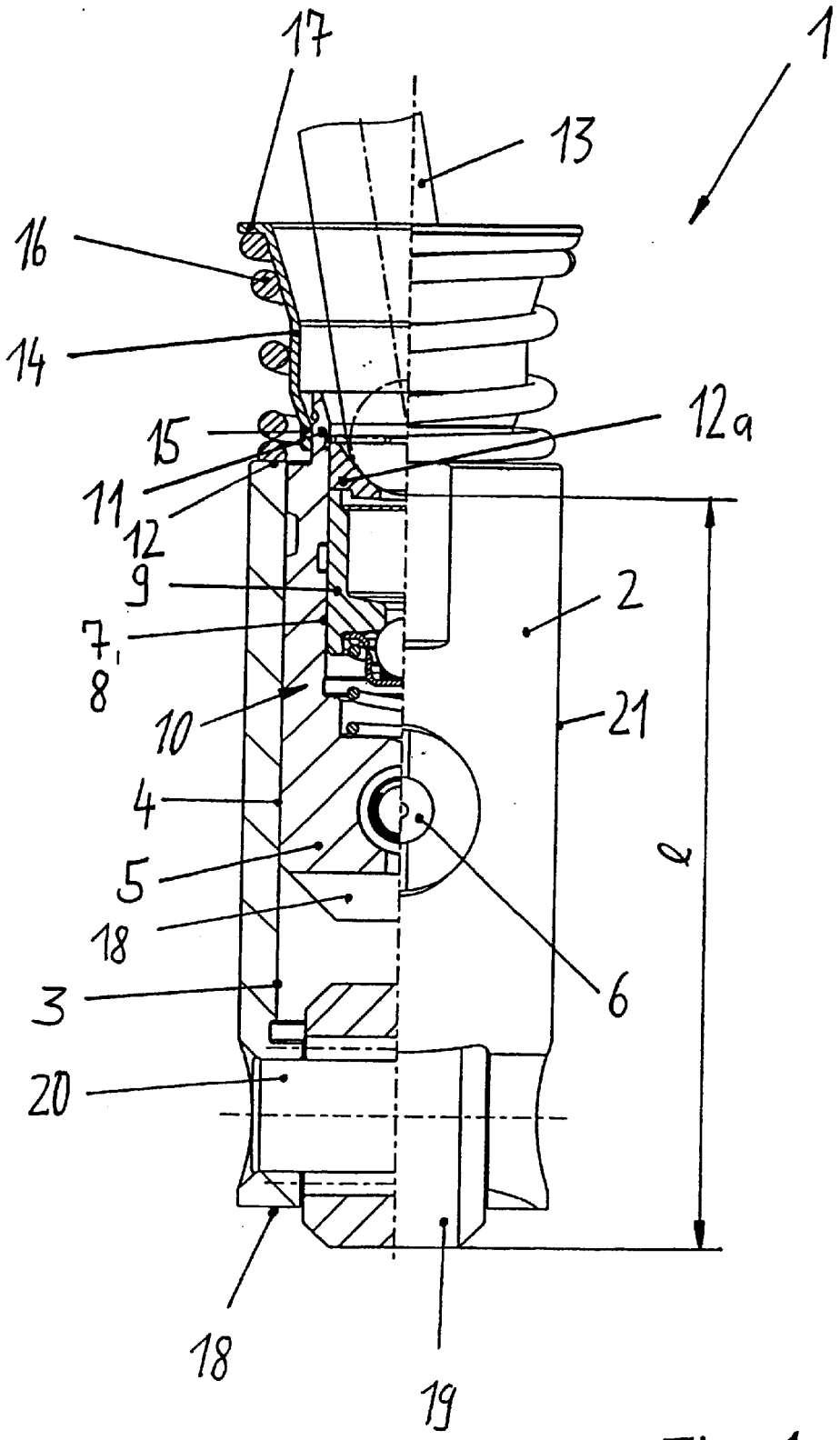
FIG. 1 is a partial longitudinal section of a switchable tappet according to the present invention.

Turning now to FIG. 1, there is shown a partial longitudinal section of a switchable tappet according to the present invention, generally designated by reference numeral 1 and intended for installation in a valve train of an internal combustion engine for directly transmitting the movement of a cam (not shown) to a push rod 13. The tappet 1 includes a housing 2 of substantial tubular configuration. The housing 2 includes a recess 3 which receives an inner element 5 guided for movement in axial direction via its outer surface area 4. A coupling element 6 is provided to selectively couple the inner element 5 with the housing 2. The inner element 5 has a bore 7 for receiving a hydraulic clearance compensation element, generally designated by reference numeral 10 and having a pressure piston 9 abutting with its outer surface area 8 against the inside bore wall. Operation and structure of a hydraulic clearance compensation element are generally known to the artisan and not described in more detail for the sake of simplicity. The pressure piston 9 is provided with an abutment 12*a* for reception of the push rod 13.

The inner element 5 is extended in the direction of the push rod 13 by a necking 11 to project beyond a rim 12 of the housing 2, when coupled with the housing 2. On its push rod proximal side, the inner element 5 is connected to a separate thinwalled attachment 14 made of sheet metal. The attachment 14 is secured to the outer surface area 4 of the inner element 5 in the area of the necking 11 by a clip connection or snap connection 15. In the direction of the push rod 13, the attachment 14 has a conically widening or funnel-shaped configuration.

A helical compression spring 16, also called lost-motion spring, has one end resting against the rim 12 of the housing 2, and another end acting against a shoulder 17 of the attachment 14. The shoulder 17 is configured as annular collar, which is formed in one piece with the attachment 14 and extends outwards therefrom. The compression spring 16 has also a conical configuration in the direction of the push rod 13. In this fashion, the overall length of the tappet 1 is kept short while still ensuring a sufficient mobility of the push rod 13 during operation of the valve drive.

On its side 18 distal to the push rod 13, the housing 2 is provided with a ramp surface 19, configured as rolling bearing mounted roller, for contact by a cam, not shown. The roller runs on a bolt 20 connected to the housing 2. In order to reduce the axial length, the inner element 5 is moved axially as closely as possible to the ramp surface 19 and formed with a cylindrical depression in movement direction. As a consequence, the inner element 5 partly covers the ramp surface 19 in the uncoupled state.

The housing has an outer surface area 21 which has a substantially smooth configuration as does the recess 3, the outer surface area 4 of the inner element 5, the bore 7 of the inner element 5 and the outer surface area 8 of the pressure piston 9. As a consequence of the substantially flat and smooth configuration of these surfaces, manufacturing costs, especially the need for grinding operations, are reduced, compared to conventional tappets.

The overall height I of the tappet 1, as measured between the outer side of the ramp surface 19 and the abutment 12*a* for the push rod 13, is now significantly smaller in size than in conventional tappets for valve trains of same internal combustion engines.

While the invention has been illustrated and described as embodied in a switchable tappet for directly transmitting a cam lift onto a tappet push rod, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed is:

1. A switchable tappet for directly transmitting a cam lift onto a tappet push rod, in a valve train of an internal combustion engine, comprising:

a housing formed with a recess and having a push rod distal end which is formed with a ramp surface for contact by a cam;

an inner element disposed in the recess for movement into at least one position in which the inner element is coupled to the housing, said inner element having a push rod proximal end formed with an abutment for the push rod;

an attachment secured to the push rod proximal end of the inner element to extend the inner element beyond the recess of the housing, wherein the attachment has a housing-distal end formed with a shoulder; and a helical compression spring, extending between the shoulder of the attachment and a rim or rim-proximal region of the housing, for urging the inner element in a direction of the push rod, and conically expanding, at least partly, in the direction of the push rod and wrapped around the attachment of complementary conical configuration.

2. The tappet of claim 1, wherein the attachment is a separate structural element and made of thinwalled light-weight material.

3. The tappet of claim 2, wherein the attachment is made of sheet metal.

4. The tappet of claim 2, wherein the attachment is made of plastic.

5. The tappet of claim 2, wherein the attachment is connected to the inner element by a clip connection or snap connection.

6. The tappet of claim 2, wherein the inner element is formed with a necking in an area of the rim of the housing for securement of the attachment.

7. The tappet of claim 1, wherein the shoulder is formed in one piece with the attachment and configured as ring collar extending from the attachment.

8. The tappet of claim 1, wherein the housing has a thinwalled structure and exhibits, at least over a major part thereof, a continuously open, tubular configuration.

9. The tappet of claim 1, wherein the ramp surface for the cam is implemented as a rotatable roller, supported by the housing via a bolt.

10. The tappet of claim 9, wherein the inner element has a ramp surface proximal side provided with a cylindrical depression which extends in the direction of the ramp surface.

11. The tappet of claim 1, and further comprising a hydraulic clearance compensation element disposed of the inner element.

12. The tappet of claim 1, wherein the housing has an outer surface area and an inner housing wall which bounds the recess, and the inner element has an outer surface area, wherein the outer surface area of the housing, the outer surface area of the inner element and the housing wall are substantially smooth over their entire length.

13. The tappet of claim 11, wherein the hydraulic compensation element has a pressure piston received in a bore of the inner element and having an outer surface area, said inner element having a wall which bounds the bore, said outer surface area of the pressure piston and the wall being substantially smooth over their entire length.

14. The tappet of claim 1, wherein the abutment is spaced from the ramp surface by a distance which corresponds to about ⅔ of an installation length of a conventional tappet for a valve drive of an internal combustion engine of this type.

* * * * *